US007252136B2

(12) United States Patent
Rieke

(10) Patent No.: US 7,252,136 B2
(45) Date of Patent: Aug. 7, 2007

(54) NUMBERING DEVICE FOR MOLDED OR CAST PARTS

(75) Inventor: Michael William Rieke, Defiance, OH (US)

(73) Assignee: General Motors Corporation, Detroit, MI (US)

( * ) Notice: Subject to any disclaimer, the term of this patent is extended or adjusted under 35 U.S.C. 154(b) by 459 days.

(21) Appl. No.: 10/899,211

(22) Filed: Jul. 26, 2004

(65) Prior Publication Data

US 2006/0016575 A1 Jan. 26, 2006

(51) Int. Cl.
*B22C 13/00* (2006.01)

(52) U.S. Cl. ..... 164/229; 164/235; 164/236; 164/412; 249/103

(58) Field of Classification Search ..... 164/229, 164/235, 236, 412, 4.1; 249/103
See application file for complete search history.

(56) References Cited

U.S. PATENT DOCUMENTS 3,129,430 A * 4/1964 Latschbacher ..... 227/113
4,137,962 A * 2/1979 Pol ..... 164/236
4,708,314 A 11/1987 Kuhling
5,057,000 A 10/1991 Mangone, Jr.
5,329,985 A 7/1994 Weimann
5,620,716 A 4/1997 Opitz
5,887,638 A 3/1999 Yoritsune et al.
5,894,005 A 4/1999 Steel et al.
5,902,512 A 5/1999 Streit
6,299,126 B1 10/2001 Hughes, II
6,354,560 B1 * 3/2002 Kawasaki et al. ..... 249/103
6,554,245 B2 4/2003 Picco et al.
6,582,197 B2 6/2003 Coulson

* cited by examiner

*Primary Examiner*—Kevin Kerns
*Assistant Examiner*—I.-H. Lin

(57) ABSTRACT

A numbering device is disclosed for marking molded cast parts, the device including a plurality of concentric cylinders having indicia disposed on an end thereof, the cylinders being rotatingly indexable to cause the indicia to move as desired to form the desired mark, the mark is then impressed into a sand mold and subsequently reproduced on the cast part.

8 Claims, 5 Drawing Sheets

10
12
14
16
18
20
22
26
28
30
32
34
36
38
40
42
44
46
48
50
52
54
56
58
60
62
64
66
68
70
72
74
76
78
80
83
84
85
86
88
90
92
94
96
98
100
102
104
106
108
110
112
114
116
118
120
122
124
126
128
130
132
134
136
138
139
140
142
144
146
148
150
152
154
13
13

10
12
14
18
30
36
38
54
56
68
74
148
150
4
4

NUMBERING DEVICE FOR MOLDED OR CAST PARTS

FIELD OF THE INVENTION

The invention relates to a numbering device and more particularly a numbering device for marking molded cast parts wherein a mark is disposed on a sand mold and subsequently reproduced on the cast part.

BACKGROUND OF THE INVENTION

It is the practice in the metal casting industry to mark or label each casting to identify the casting for quality control purposes and to aid in obtaining an accurate production count. The identification marks generally contain such information as the hour of the day or the shift during which the casting was made. Proper identification requires the mark to be changed periodically in order to be accurate. Although other information may also be included, the present invention concerns itself with a portion of the mark which requires updating for each casting.

A convenient method of displaying information is by a series of reference marks located about the circumference of a circle and an indicator mark located within the circle and pointing to a desired reference mark. An example of this technique is the face of a clock. When a foundry desires to indicate the hour during which a casting was made, this information is displayed on the surface of the casting as a series of reference marks located in equal intervals about the circumference of a circle and serving as the hour marks. A pointer mark located within the circle acts as an hour hand. Thus, the hour hand mark would point to the two-hour mark for castings made between 2 and 3 o'clock. At 3 o'clock the position of the hour hand mark would be changed. In a similar fashion other information such as the day of the week or the shift during which the casting was produced might be displayed.

A preferred method for producing a lasting mark upon the surface of a casting is to incorporate a marker or series of markers in a pattern as part of its mold-forming surface. As the pattern is employed to form the green sand or other suitable material into the mold, the image of the markers is impressed into the mold surface. The mark is then cast as part of the surface of the metal.

Typically, changing or updating the mark is difficult. Using one method, an operator is required to enter a molding machine in order to reach the pattern surface and manually change the marker. This procedure is not only time consuming, but requires elaborate safety precautions to protect the operator while inside the machine. However, development of a numbering or marking device allowing the operator to change the mark from outside the molding machine has been hampered because of the durable construction necessary to withstand the tremendous jolts and pressure of the mold-forming operations.

It would be desirable to produce a numbering device which facilitates a changing of a mark as desired and maximizes production efficiency.

SUMMARY OF THE INVENTION

Consistent and consonant with the present invention, a numbering device which facilitates a changing of a mark as desired and maximizes production efficiency, has surprisingly been discovered.

In one embodiment, the mold for sand casting of engine cylinder blocks comprises a main body having indicia disposed thereon; a marking assembly disposed in the main body and having a plurality of movable markers formed thereon for marking a surface, the markers cooperating with the indicia of the main body to provide identifying information; and an indexing assembly adapted to be connected to an actuator which causes a movement of the indexing assembly, the indexing assembly being operatively engaged with the marking assembly whereby the movement of the indexing assembly causes a movement of at least one of the markers of the marking assembly.

In another embodiment, the mold comprises a main body having a first end and a second end, the first end having indicia disposed thereon; a marking assembly disposed in the main body, the marking assembly including a plurality of concentric rotatable cylinders, each of the cylinders having a marker formed thereon for marking the molded part, whereby a rotation of the cylinders causes a corresponding movement of the markers, the markers of the cylinders cooperating with the indicia of the main body to provide identifying information for the molded part; an indexing assembly disposed in the main body adjacent the marking assembly, the indexing assembly including a piston and an indexing member, the indexing assembly being operatively engaged with the marking assembly whereby a movement of the indexing assembly causes a movement of at least one of the cylinders of the marking assembly; and a cap adapted to be in selective communication with a source of pressure fluid which causes the piston to be reciprocated to cause the indexing member to rotate the at least one of the cylinders.

The invention also provides methods of sequentially marking a series of molded parts. One method comprises the steps of providing a marking device comprising a main body having indicia disposed thereon; a marking assembly disposed in the main body and having a plurality of movable markers formed thereon for marking the molded part, the markers cooperating with the indicia of the main body to provide sequential identifying information; and an indexing assembly adapted to be connected to an actuator which causes a movement of the indexing assembly, the indexing assembly being operatively engaged with the marking assembly whereby the movement of the indexing assembly causes a movement of at least one of the markers of the marking assembly; causing the indicia and the markers to be impressed into a sand mold; molding a part with the sand mold to include the impression of the indicia and markers thereon; causing movement of at least one of the markers to a next sequential position; and repeating as desired the steps of causing the indicia and the markers to be impressed into a sand mold; molding a part with the sand mold to include the impression of the indicia and markers thereon; and causing movement of at least one of the markers to a next sequential position.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figures 1, 1A:
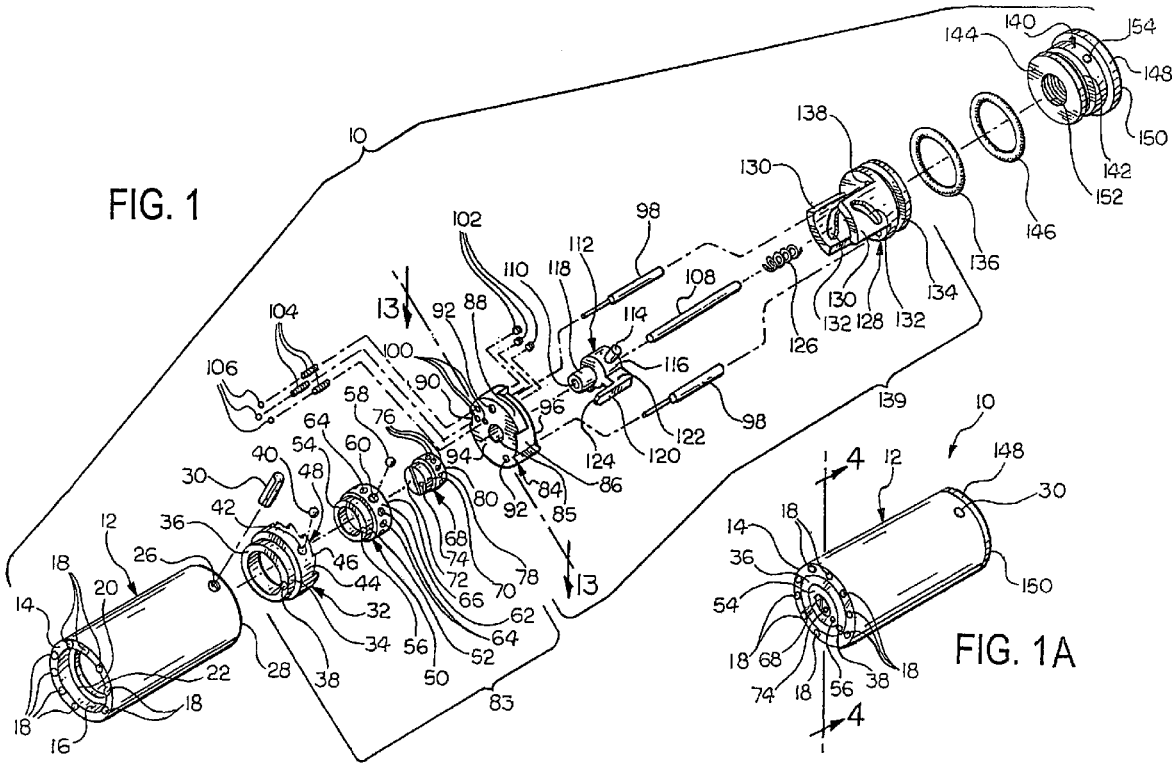
FIG. 1 is an exploded perspective view of a numbering device according to an embodiment of the invention.
FIG. 1A is a perspective view of the numbering device illustrated in FIG. 1 showing the numbering device assembled.

Referring now to FIG. 1, a numbering device 10 according to an embodiment of the invention is shown. The numbering device 10 includes a hollow main body 12. The main body 12 has a circular cross section in the embodiment shown. A first end 14 includes a radially inwardly extending lip 16. A plurality of spaced apart protuberances or indicia 18 is formed on an outer surface of the lip 16. As clearly illustrated in FIGS. 2 and 3, the protuberances 18 form a pattern representing numbered positions about the lip 16. A template T is shown overlaying the protuberances 18 and showing the numbered positions. A protuberance 18 is not formed at the location designated '0' in order to assist in determining the proper orientation of the numbering system. It is understood that other markers instead of numerals could be used such as letters, for example, without departing from the scope and spirit of the invention. Additionally, more or fewer protuberances 18 can be used as desired. The protuberances 18 can also be replaced by other locating indicia as desired, such as indentations, for example. The purpose of the protuberances 18 or other locating indicia is merely to assist in properly locating and orienting the template T and to obtain an accurate count, which is further explained herein. A channel 20 is formed on an inner wall 22 of the main body 12 adjacent the first end 14. A cam lobe 24 is formed in the channel 20 as clearly illustrated in FIGS. 4-12. A through hole 26 is formed adjacent a second end 28 of the main body 12 and is adapted to receive a locking pin 30 therein.

A first hollow rotatable cylinder 32 is adapted to be rotatably received in the hollow portion of the main body 12. A shoulder portion 34 is formed on a first end 36 of the first cylinder 32. The shoulder 34 is adapted to be rotatingly received by the lip 16 of the main body 12. A protuberance or marker 38 is formed on an outer surface of the first end 36. It is understood that indentations or other markers 38 can be used in place of the protuberance 38. A ball or driving member 40 is received in an aperture 42 formed in an outer wall 44 of the first cylinder 32. Driving members 40 other than those having a spherical shape can be used as desired. An annular array of teeth 46 is formed on a second end 48 of the first cylinder 32, as clearly indicated in FIG. 14.

Figure 14:
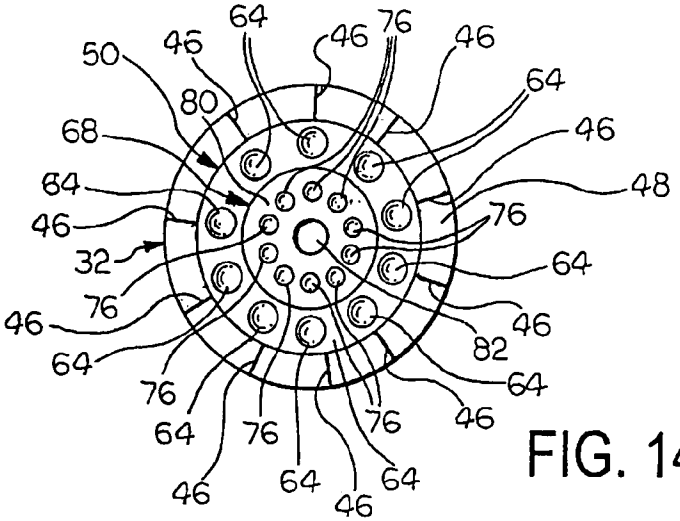
FIG. 14 is a top end view of the first rotatable cylinder, the second rotatable cylinder, and the third rotatable cylinder illustrated in FIG. 1 and shown assembled.

A second hollow rotatable cylinder 50 is adapted to be rotatably received in the hollow portion of the first cylinder 32. A shoulder portion 52 is formed on a first end 54 of the second cylinder 50. The shoulder 52 is adapted to be rotatingly received adjacent a radial inner surface of the shoulder 34 of the first cylinder 32. A protuberance or marker 56 is formed on an outer surface of the first end 54. It is understood that indentations or other markers 56 can be used in place of the protuberance 56. A ball or driving member 58 is received in an aperture 60 formed in an outer wall 62 of the second cylinder 50. Driving members 58 other than those having a spherical shape can be used as desired. A plurality of spaced apart indentations 64 are formed in the outer wall 62 and a second end 66 of the second cylinder 50, as illustrated in FIG. 14.

A third rotatable cylinder 68 is adapted to be rotatably received in the hollow portion of the second cylinder 50. A shoulder portion 70 is formed on a first end 72 of the third cylinder 68. The shoulder 70 is adapted to be rotatingly received adjacent a radial inner surface of the shoulder 70 of the second cylinder 50. A protuberance or marker 74 is formed on an outer surface of the first end 72. It is understood that indentations or other markers can be used in place of the protuberance 74. A plurality of spaced apart indentations 76 are formed in an outer wall 78 and a second end 80 of the third cylinder 68, as illustrated in FIG. 14. A central aperture 82 is formed in the second end 80 of the third cylinder 68. Together, the first cylinder 32, the second cylinder 50, and the third cylinder 68 form a marking assembly 83.

Figure 13:
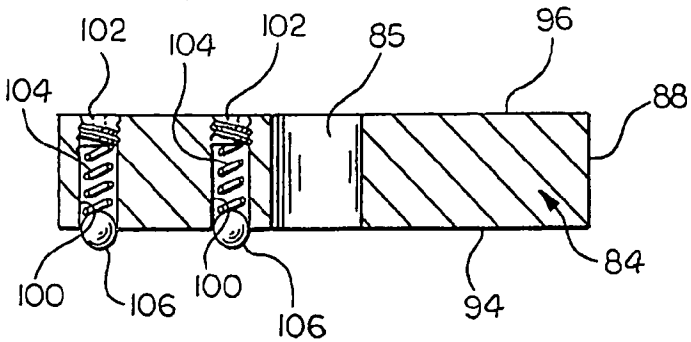
FIG. 13 is a sectional view of an idler member illustrated in FIG. 1 taken along line 13-13.

A disc shaped idler member 84 having a central aperture 85 abuts the second ends 48, 66, 80 of the cylinders 32, 50, 68 and is received in the main body 12. A first slot 86 is formed in an outer surface 88 of the idler member 84. A second slot 90 spaced from the first slot 86 is formed in the outer surface 88. A pair of through holes 92 are formed to extend from a first end 94 to a second end 96 of the idler member 84. The through holes 92 are adapted to receive one end of a pin 98 therein. Three stop holes 100 are formed to extend from the first end 94 to the second end 96. A plug 102 is received in each of the stop holes 100. A stop spring 104 is inserted in the stop holes 100 to be interposed between the plug 102 and a stop ball 106 to urge the stop ball 106 towards the first end 94 of the idler member 84. The orientation of the plugs 102, the stop springs 104, and the stop balls 106 is clearly illustrated in FIG. 13. The radial inner two stop holes 100 are aligned with corresponding indentations 64, 76 formed in the second cylinder 50 and the third cylinder 68. The stop balls 106 of the radial inner two stop holes 100 are received in the corresponding indentations 64, 76. The radial outermost stop hole 100 is aligned with the teeth 46 formed in the first cylinder 32 and glide over the teeth 46 to come to rest in the valleys formed therebetween. It is understood that other structures can be used in place of the stop balls 106 without departing from the scope and spirit of the invention. These structures may include pins or pistons having a conically shaped end to abut the indentations 64, 76 and the teeth 46, for example.

One end of a shaft 108 extends through a central aperture 110 formed in an indexing member 112 to extend through the aperture 85 formed in the idler member 84 and be received in the aperture 82 formed in the third cylinder 68. An arm 114 extends radially outwardly from diametrically opposed sides of an outer surface 116 of the indexing member 112. A sleeve 118 extends axially outwardly from the indexing member 112 and is received in the aperture 85 of the idler member 84. An indexing arm 120 extends in an axial direction from a protuberant portion 122 of the indexing member 112. The indexing arm 120 extends through the first slot 86 of the idler member 84. A distal end 124 of the indexing arm 120 abuts and operatively engages the teeth 46 of the first cylinder 32.

A spring 126 surrounds the shaft 108. One end of the spring 126 abuts the indexing member 112. The other end of the spring 126 abuts a piston 128. The piston 128 receives the shaft 108 in a central aperture (not shown). A pair of diametrically opposed fins 130 extend axially outwardly from the piston 128 towards the idler member 84. Each of the fins 130 has a camming slot 132 formed therein. The camming slots 132 are sloped with respect to an axial direction of the piston 128. Each camming slot 132 is adapted to slidingly receive one of the arms 114 therein. A circumferential channel 134 is formed in the piston 128 at the end opposite the fins 130 and is adapted to receive an o-ring 136 therein which sealing engages the inner wall 22 of the main body 12. A pair of diametrically opposed apertures 138 formed adjacent the fins 130 receive the end of the pins 98 therein. Together, the idler member 84, the indexing member 112, and the piston 128 form an indexing assembly 139. It is understood that other indexing assemblies 139 could be used instead of the idler member 84, the indexing member 112, and the piston 128 without departing from the scope and spirit of the invention. Such indexing assemblies can include a hinged flap gate actuated with an indexing arm formed thereon to contact the teeth 46 of the first cylinder 32, for example.

A hollow end cap 140 is received in the hollow portion of the main body 12. A circumferential channel 142 is formed at a first end 144 and receives an o-ring 146 therein which sealing engages the inner wall 22 of the main body 12. A lip 148 formed at a second end 150 of the cap 140 abuts the second end 28 of the main body 12. The hollow interior formed by the interior wall 152 of the cap is adapted to receive an actuator (not shown) such as a mechanical device or a source of pressure fluid such as compressed air or hydraulic system, for example. An aperture 154 is formed in the outer wall of the cap 140 and is aligned with the hole 26 to receive the locking pin 30 therein. The numbering device is shown assembled in FIG. 1A.

Figure 15:
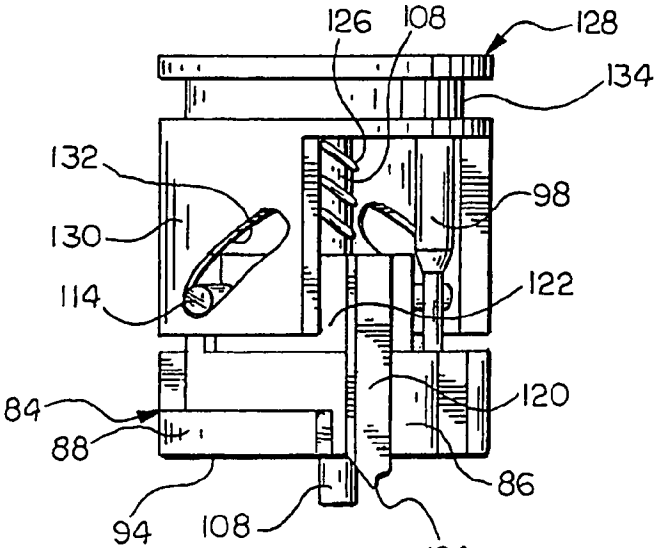
FIG. 15 is an elevational view of an idler member, an indexing member, and a piston member illustrated in FIG. 1 and shown in an expanded position.

In operation, the actuator is connected to the cap 140. When it is desired to incrementally move the numbering device 10, the actuator causes a force to be exerted on the piston 128. The piston 128 is caused to move against the force of the spring 126 from the extended position illustrated in FIG. 15 to the compressed position illustrated in FIG. 16. As the piston 128 is compressed, each of the arms 114 is caused to begin to slide in the respective camming slot 132. The movement of the arms 114 cause the indexing member 112 to begin to rotate on the shaft 108. As the indexing member 112 rotates, the indexing arm 120 is caused to slide along the first slot 86. The distal end 124 of the indexing arm 120 engages one of the teeth 46 of the first cylinder 32 to cause the first cylinder 32 to rotate.

Figure 16:
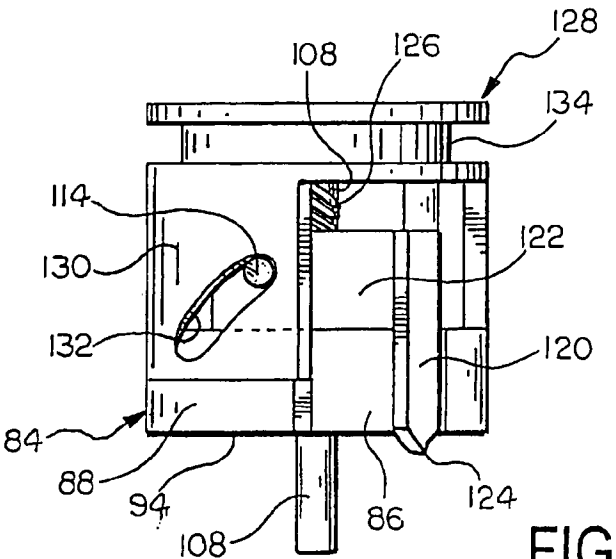
FIG. 16 is an elevational view of the idler member, the indexing member, and the piston member illustrated in FIGS. 1 and 15 and shown in a compressed position.

Once the piston 128 reaches the compressed position shown in FIG. 16, the arm 114 has reached the end of the camming slot and the indexing arm 120 has reached the end of the first slot 86. The actuator relieves the pressure exerted on the piston 128 and the spring 126 causes the piston 128 to return to the extended position illustrated in FIG. 15. This causes the arms 114 to slide within the camming slots 132, the indexing member 112 to rotate back to its original position, and the indexing arm 120 to return to the position shown in FIG. 15. The distal end 124 of the indexing arm 120 slides back along the surface of the teeth 46 of the first cylinder 32 without causing the first cylinder 32 to rotate.

The actuator causes the numbering device 10 to be incrementally moved or indexed one position, or to add one unit to the count. Thus, the protuberance illustrated in FIG. 2 will have been incrementally moved one position to that indicated in FIG. 3. The incremental movement of the first cylinder 32, and consequently, the protuberance 38, is controlled by the balls 40, 58 and the stop balls 106. As indicated, the pulse of air causes first cylinder 32 to incrementally rotate due to the engagement of the distal end 124 of the indexing arm 120. At rest, the radially outermost stop ball 106 is seated between a pair of teeth 46, thus militating against rotational movement of the first cylinder 32. When the first cylinder is incrementally moved by the distal end 124 of the indexing arm 120, the stop ball 106 is moved against the forced of the stop spring 104 and over the end of one of the teeth 46, until the stop ball 106 comes to rest between the next set of teeth 46. The stop ball 106 militates against the first cylinder 32 rotating when the indexing arm 120 is returned to the position shown in FIG. 15. The process is repeated each time the actuator applies a force to the piston 128 of the numbering device 10. The two radially innermost stop balls 106 operate in a similar manner by cooperating with the indentations 64, 76, thus militating against undesirable movement of the second cylinder 50 and the third cylinder 68.

Figure 4:
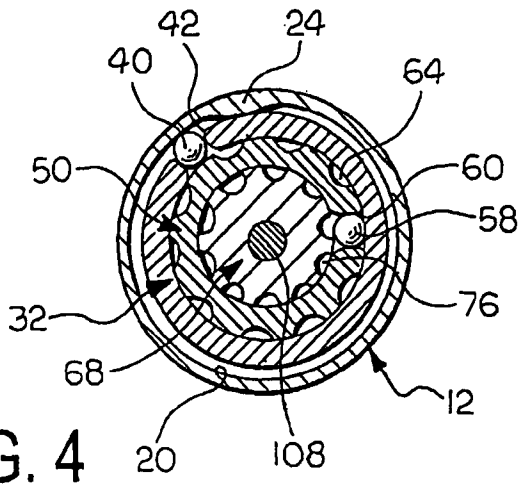
FIG. 4 is a sectional view of the numbering device illustrated in FIG. 1A and taken along line 4-4.
Figure 7:
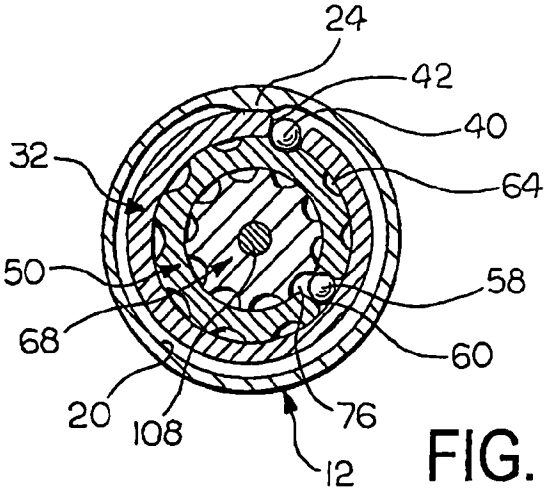
FIG. 7 is a sectional view of the numbering device illustrated in FIG. 4 showing a ball immediately after contact with a cam lobe.
Figure 9:
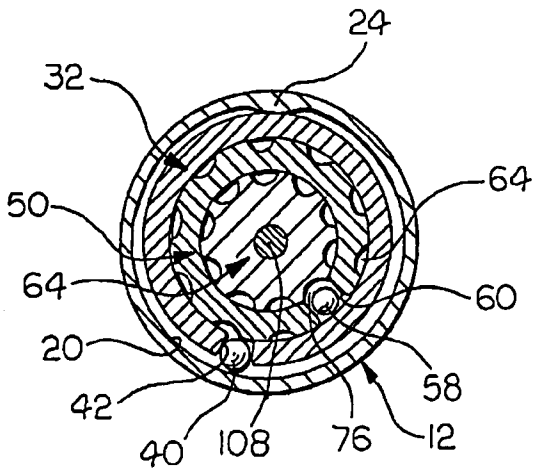
FIG. 9 is a sectional view of the numbering device illustrated in FIG. 4 showing a ball traversing an outer race.
Figure 6:
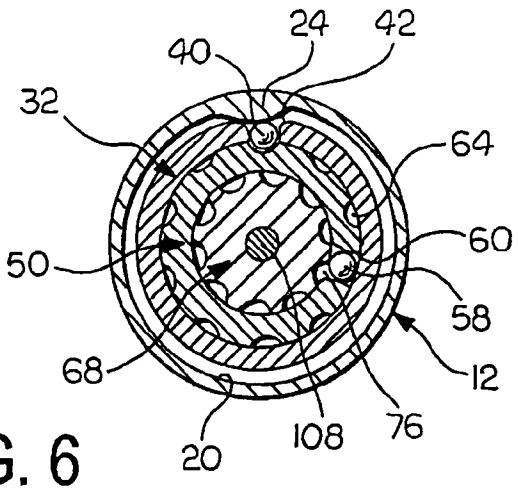
FIG. 6 is a sectional view of the numbering device illustrated in FIG. 4 showing a ball during contact with a cam lobe and during incrementally moving of the second rotatable cylinder.
Figure 8:
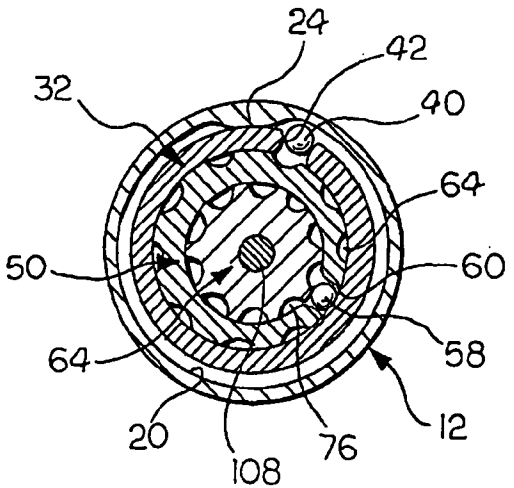
FIG. 8 is a sectional view of the numbering device illustrated in FIG. 4 showing a ball shifted radially outwardly and out of contact with the second rotatable cylinder.

FIG. 4 shows the ball 40 in the channel 20 formed in the main housing 12 at the ninth position. In FIGS. 5-8, the ball 20 is shown being moved from position 9 to position 0, and making contact with the cam lobe 24 as the first cylinder 32 is incrementally moved. The ball 40 is caused to move through the aperture 42 and into the indentation 64 by the cam lobe 24. The cam lobe 24 holds the ball 40 in the indentation 64 while the first cylinder 32 is being incrementally moved and causing the ball 40 to be moved from position 9 to position 0. Thus the second cylinder 50 is caused to rotate one position when the ball 40 is in contact with the cam lobe 24. Once the ball 40 has been incrementally moved past the cam lobe 24, the ball 40 moves outwardly into the channel 20 and continues to traverse the channel 20 each time the first cylinder 32 is incrementally moved, as shown in FIG. 9.

Figure 10:
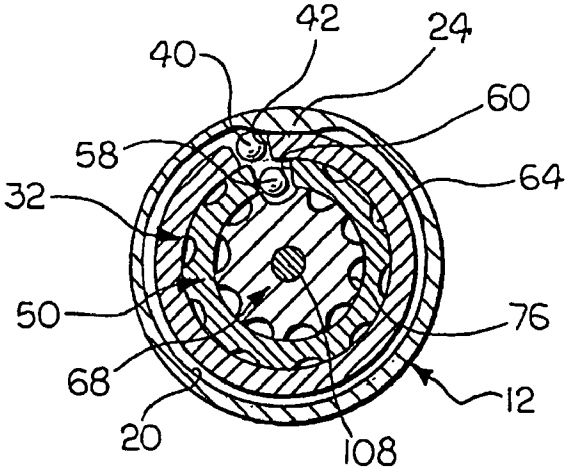
FIG. 10 is a sectional view of the numbering device illustrated in FIG. 4 showing a ball immediately prior to contact with a cam lobe and prior to incrementally moving the second rotatable cylinder and the third rotatable cylinder.
Figure 12:
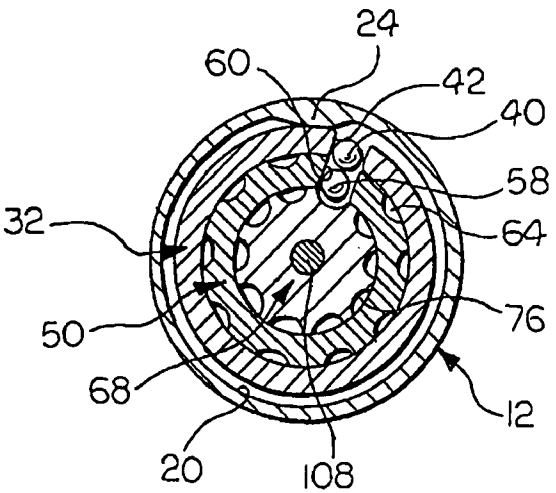
FIG. 12 is a sectional view of the numbering device illustrated in FIG. 4 showing a ball immediately after contact with a cam lobe and prior to being shifted radially outwardly.
Figure 11:
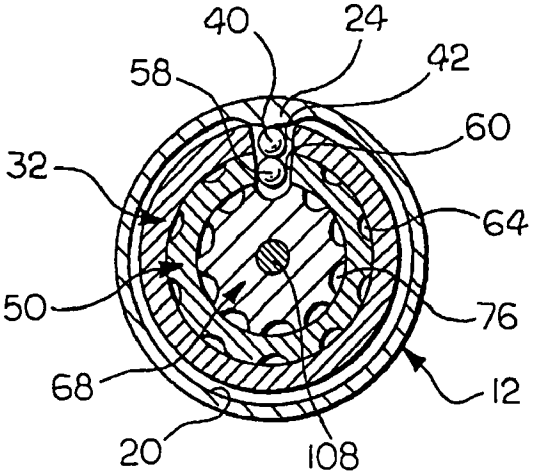
FIG. 11 is a sectional view of the numbering device illustrated in FIG. 4 showing a ball during contact with a cam lobe and during incrementally moving of both the second rotatable cylinder and the third rotatable cylinder.

Once both the ball 40 and the ball 58 have been incrementally moved to position 9, the third cylinder 68 will be incrementally moved. FIGS. 10-12 show the incremental movement of the third cylinder 68. As illustrated in FIG. 10, when the ball 40 is caused to contact the cam lobe 24, the ball is caused to move through the aperture 42 and into contact with the ball 58. The ball 58 is then caused to move into the indentation 76, thus the first cylinder 32, the second cylinder 50, and the third cylinder 68 are all simultaneously incrementally moved. Once the ball 40 has cleared the cam lobe 24, the ball 40 moves outwardly into the channel 20 and the ball 58 moves out of the indentation 76. The ball 40 is free to continue to traverse the channel 20 each time the first cylinder 32 is incrementally moved.

In the embodiment described herein, the numbering device is used to sequentially number castings to identify a production time, order, and the like. In casting operations, it may be necessary to identify and segregate a group of castings due to quality or other issues. While current practice involves the use of a date mark, a shift mark, an hour mark, or a combination of these marks, the need exists for a mark which aids in the identification of the specific casting order. Additionally, the date, shift, and hours marks typically require manual manipulation to change, resulting in productivity losses.

Figure 3:
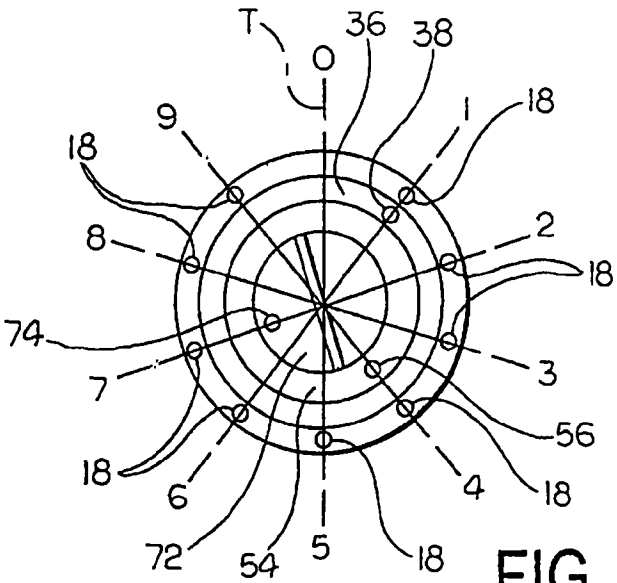
FIG. 3 is a bottom view of the numbering device illustrated in FIGS. 1 and 1A showing the first rotatable cylinder, the second rotatable cylinder, and the third rotatable cylinder in a second position.
Figure 2:
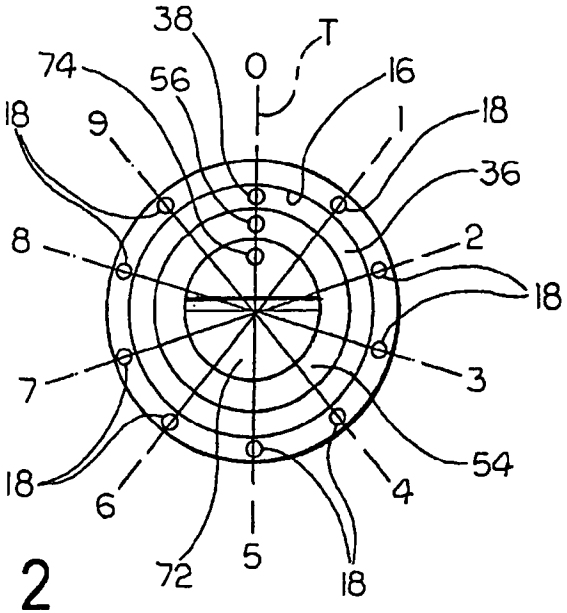
FIG. 2 is a bottom view of the numbering device illustrated in FIGS. 1 and 1A showing a first rotatable cylinder, a second rotatable cylinder, and a third rotatable cylinder in a first position.
Figure 5:
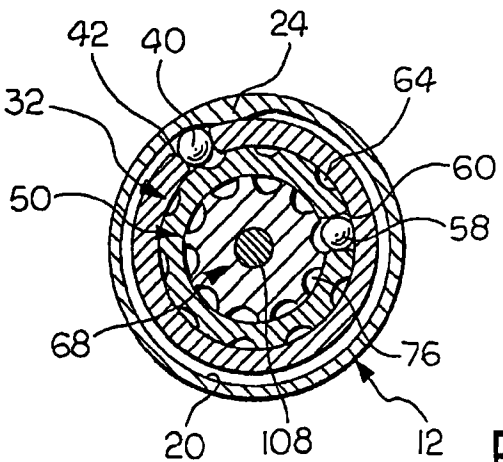
FIG. 5 is a sectional view of the numbering device illustrated in FIG. 4 showing a ball immediately prior to contact with a cam lobe and prior to incrementally moving of the second rotatable cylinder.

The numbering device 10 as disclosed herein facilitates a counting of castings from 0 to 999. Using a template T having the cross-lines and numerals as shown in FIGS. 2 and 3, the positions of the protuberances 38, 56, 74 can be used to represent the current count. Each time the first cylinder 32 is incrementally moved as described herein, the protuberance 38 is also incrementally moved. Thus, the protuberance 38 represents the numbers 0-9. Each time the protuberance 38 makes a complete revolution, the second cylinder is incrementally moved, causing the protuberance 56 to be incrementally moved once. Thus, the protuberance 56 represents the numbers 0x, 1x, 2x, 3x, 4x, 5x, 6x, 7x, 8x, and 9x. Each time the protuberance 56 makes a complete revolution, the third cylinder 68 is caused to be incrementally moved once. Therefore, the protuberance 74 represents the numbers 0xx, 1xx, 2xx, 3xx, 4xx, 5xx, 6xx, 7xx, 8xx, and 9xx. For example, in FIG. 2, the protuberances 38, 56, 74 are in a position represented by '000'. In FIG. 3, the protuberances 38, 56, 74 are in a position represented by '741'.

In a casting operation, the numbering device 10 can be mounted in a mold or foundry pattern. The face created by the first end 14, 36, 54, 72 of the main body 12, the first cylinder 32, the second cylinder 50, and the third cylinder 68, respectively, leaves an imprint of the position of the protuberances 18, 38, 56, 74 in the casting, which can later be observed using the template T to accurately determine the appropriate count. As discussed, the numbering device 10 can be used to directly imprint a part, as opposed to imprinting a sand mold. However, in order to obtain the same marking which indexes in a clockwise fashion, the indicator pattern and direction of motion must be reversed from that described herein.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A marking device for a molded part comprising:

a main body having a first end and a second end, the first end having indicia disposed thereon;

a marking assembly disposed in said main body, said marking assembly including a plurality of concentric rotatable cylinders, each of the cylinders having a marker formed thereon for marking the molded part, whereby a rotation of the cylinders causes a corresponding movement of the markers and a rotation of at least one of the cylinders is caused by a rotation of another of the cylinders, the markers of the cylinders cooperating with the indicia of said main body to provide identifying information for the molded part;

an indexing assembly disposed in said main body adjacent said marking assembly, said indexing assembly including a piston and an indexing member, said indexing assembly being operatively engaged with said marking assembly whereby a movement of said indexing assembly causes a movement of at least one of the cylinders of said marking assembly; and a cap adapted to be in selective communication with a source of pressure fluid which causes the piston to be reciprocated to cause the indexing member to rotate the at least one of the cylinders wherein the piston includes a pair of diametrically opposed tabs having a camming slot formed therein, the camming slots cooperating with a pair of radially outwardly extending arms of the indexing member to cause the indexing member to rotate the at least one of the cylinders.

2. The marking device according to claim 1, wherein the at least one of the cylinders rotated by the indexing member includes an annular array of teeth formed in an end thereof.

3. The marking device according to claim 2, wherein the indexing member includes an indexing arm extending axially outwardly therefrom, the indexing arm engaging the teeth of the at least one of the cylinders to rotatingly drive the at least one of the cylinders.

4. The marking device according to claim 1, wherein the indicia are a plurality of indentations formed on the first end of said main body.

5. The marking device according to claim 1, wherein the indicia are a plurality of protuberances formed on the first end of said main body.

6. The marking device according to claim 1, wherein the markers are indentations.

7. The marking device according to claim 1, wherein the markers are protuberances.

8. The marking device according to claim 1, wherein the identifying information is a numbering system from zero to 999.

* * * * *